US006155878A

United States Patent [19]

Chen

[11] Patent Number: 6,155,878

[45] Date of Patent: Dec. 5, 2000

[54] ELECTRICAL CONNECTOR WITH SEPARATE SHIELD AND GROUNDING MEMBER

[75] Inventor: Chien Cheng Chen, Tu-Chen, Taiwan

[73] Assignee: Hon Hai Precision Ind. Oc., Ltd., Taipei Hsien, Taiwan

[21] Appl. No.: 09/464,323

[22] Filed: Dec. 15, 1999

[51] Int. Cl.[7] ..... H01R 13/648

[52] U.S. Cl. ..... 439/607; 439/108

[58] Field of Search ..... 439/607, 609, 439/108, 867

[56] References Cited

U.S. PATENT DOCUMENTS

| | | | |
|---|---|---|---|
| 5,035,652 | 7/1991 | Shibano | 439/108 X |
| 5,102,350 | 4/1992 | Janota et al. | 439/607 |
| 5,423,696 | 6/1995 | Sato | 439/607 |
| 6,050,854 | 4/2000 | Fang et al. | 439/607 |

*Primary Examiner*—Renee Luebke
*Attorney, Agent, or Firm*—Wei Te Chung

[57] ABSTRACT

An electrical connector comprises an insulative housing, a number of terminals received in the housing, a pair of grounding members, and a shield. The housing defines a mating opening at a front face thereof. Each of the two side walls of the housing defines a recess, and a pair of grooves is defined in both lateral walls of the recesses and in communication with a bottom of the housing. Each grounding member comprises a main body for inserting into the grooves of the housing by two edges of the main body from the bottom of the housing, and a solder pad for soldering to the printed circuit board. A protruding rib is formed on the main body. The shield covers the housing, two resilient arms extending inwardly from both lateral plates of the shield to electrically contact the protruding rib of the grounding member for grounding.

4 Claims, 4 Drawing Sheets

ELECTRICAL CONNECTOR WITH SEPARATE SHIELD AND GROUNDING MEMBER

BACKGROUND OF THE INVENTION

The present invention relates to a connector, and particularly to a modular jack having a shield and a grounding member separate from the shield.

Modular jack connectors are prevalently in use in the telecommunications industry, matable to modular plug connectors commonly terminated to multi-conductor cable for signal transmission. One example of such a modular jack (see FIG. 4) is disclosed in U.S. Pat. No. 5,772,466, in which an insulative housing 50 is covered by a shield 60. The shield 60 includes two side walls 62, a grounding tail 64 extending downwardly from each side wall 62 for being received in a through hole 72 of a printed circuit board 70 for connection to a ground circuit thereof. The surface of the shield 60 is usually electroplated with nickel for cosmetic reasons, and each grounding tail 64 is usually electroplated with tin to aid in soldering. However, the conventional shield with the grounding tails is stamped from a one piece blank. If the surface of the shield is electroplated with nickel and the grounding tail is electroplated with tin, two electroplating steps will be involved thereby making the manufacturing difficult and increasing cost. If the surface of the shield and the grounding tail are both electroplated with nickel, the soldering characteristics of the grounding tail will be poor. If the shield is electroplated with tin, the visual appearance of the modular jack will be poor and the tin-plate on the surface of the shield will melt when the shield is soldered at high temperature. Hence, an improved electrical connector is required to overcome the disadvantages of the prior art.

BRIEF SUMMARY OF THE INVENTION

A main object of the present invention is to provide a modular jack connector, the shield and the grounding tail of which are made separately, thereby improving the appearance of the shield and the soldering characteristics of the grounding member.

To achieve the above objects, a modular jack connector comprises an insulative housing, a plurality of terminals received in the housing, a pair of grounding members, and a shield. The housing is roughly a cube, a mating opening being defined in a front face thereof. Each of the two side walls of the housing defines a recess, and a pair of grooves is defined in both lateral walls of the recesses and in communication with a bottom of the housing. Each grounding member comprises a main body for inserting into the grooves of the housing by two edges of the main body from the bottom of the housing, and a solder pad for soldering to a printed circuit board. A protruding rib is formed on the main body. The shield covers the housing, two resilient arms extending inwardly from both lateral plates of the shield to electrically contact the protruding rib of the grounding member for grounding.

Other objects, advantages and novel features of the invention will become more apparent from the following detailed description of the present embodiment when taken in conjunction with the accompanying drawings.

DETAILED DESCRIPTION OF THE INVENTION

Figure 1:
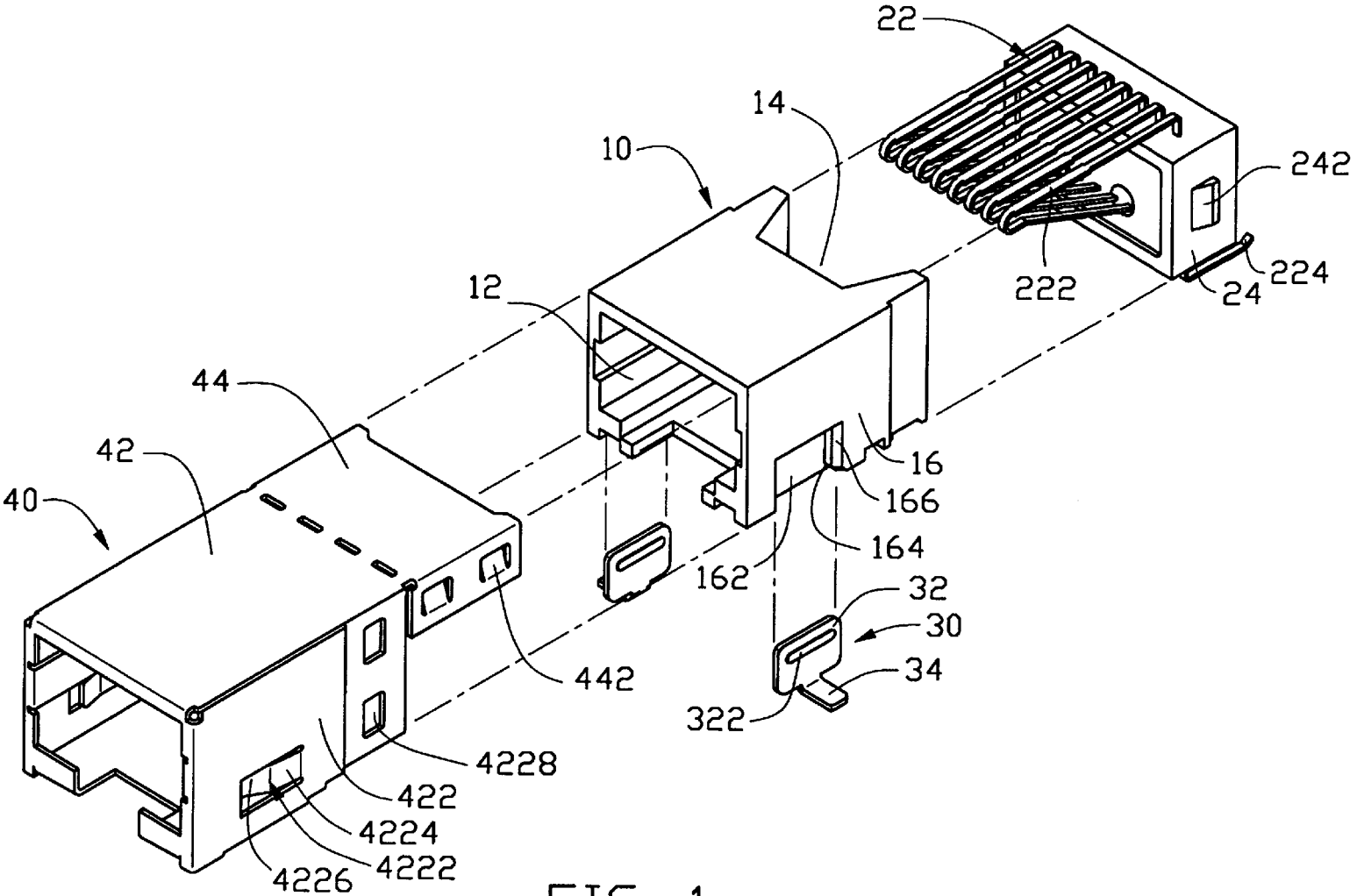
FIG. 1 is an exploded view of an electrical connector in accordance with the present invention.

Referring to FIG. 1, a modular jack connector in accordance with the present invention comprises an insulative housing 10, a plurality of terminals 22 insert molded with an insert block 24 and received in the housing 10, a pair of grounding members 30 mounted on the housing 10 for soldering to a printed circuit board (not shown), and a shield 40 covering the housing 10.

The housing 10 is roughly a cube, a mating opening 12 being defined in a front face thereof and a mounting opening 14 being defined in a rear face thereof. An inner face of each side wall 16 of the housing 10 defines a slot (not shown). Each of side walls 16 defines a recess 162 adjacent to a bottom side (not shown) of the housing 10, a pair of grooves 164 being defined in both lateral walls of the recesses 162 and being in communication with the bottom side (not shown) of the housing 10. An edge of each recess 162 forms an incline 166 from the side wall 16 to the groove 164.

Each terminal 22 comprises a contact portion 222 extending from an upper end of the insert block 24 for contacting with a mating connector (not shown), and a solder portion 224 extending from a bottom end of the insert block 24 for soldering to the printed circuit board (not shown). A pair of protrusions 242 is formed on both side walls (not labelled) of the insert block 24 for engaging with the slots (not shown) of the housing 10.

The grounding member 30 comprises a main body 32, and a solder pad 34 perpendicular to the main body 32 for soldering to the printed circuit board. A protruding rib 322 projects from the main body 32 and extends in the same direction as the solder pad 34.

The shield 40 comprises a front portion 42 for covering the housing 10 except for the mating opening 12 and the mounting opening 14, and a rear portion 44 extending from a rear edge of the front portion 42 for covering the mounting opening 14 of the housing 10. The front portion 42 has a pair of lateral plates 422, each plate 422 forming a resilient arm 4222 extending inwardly therefrom. Each resilient arm 4222 comprises a bevel arm 4224 connecting with the lateral plate 422, and a contact arm 4226 for abutting against the protruding rib 322. A pair of indentations 4228 is defined in a rear edge of each lateral plate 422, and a pair of clip portions 442 is correspondingly formed on each side (not labelled) of the rear portion 44 of the shield 40 for engaging with the indentations 4228.

Figure 2:
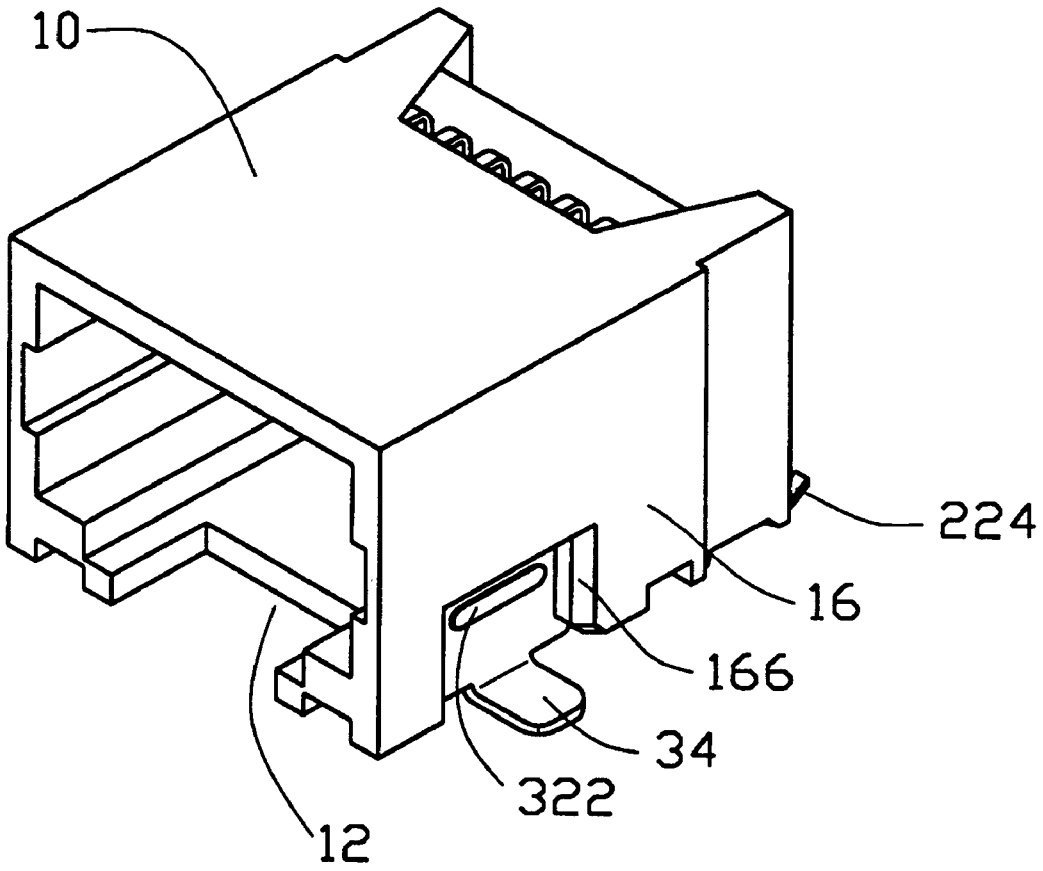
FIG. 2 is a partially assembled view of the connector of FIG. 1.
Figure 3:
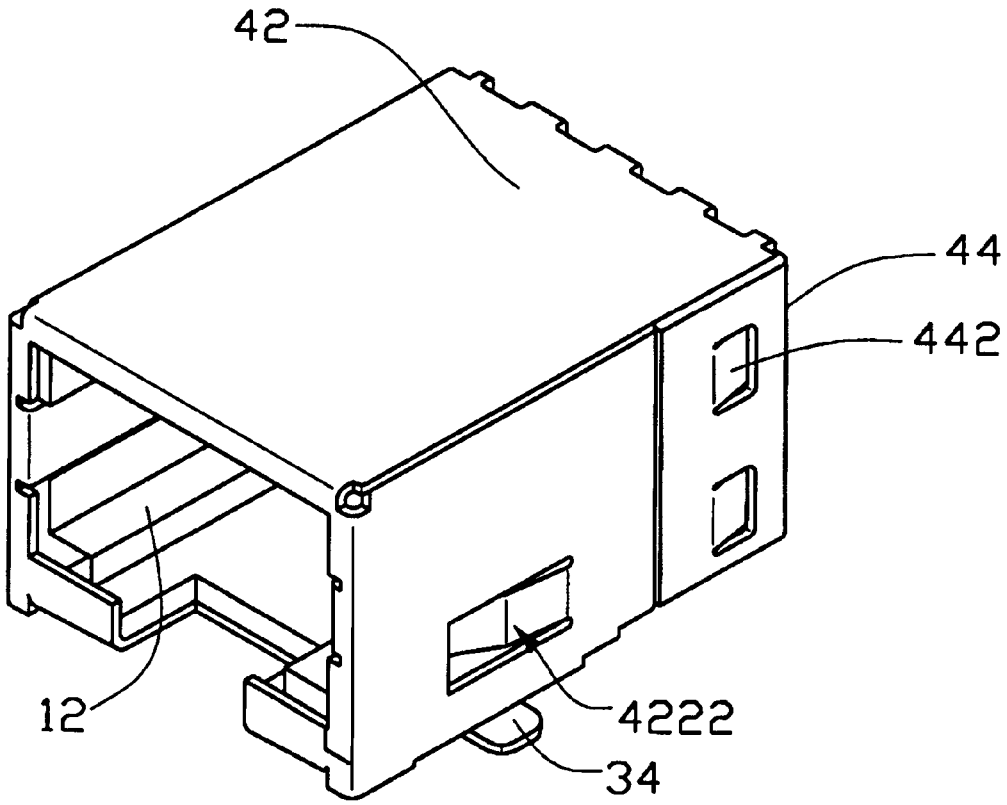
FIG. 3 is an assembled view of an electrical connector in accordance with the present invention.
Figure 4:
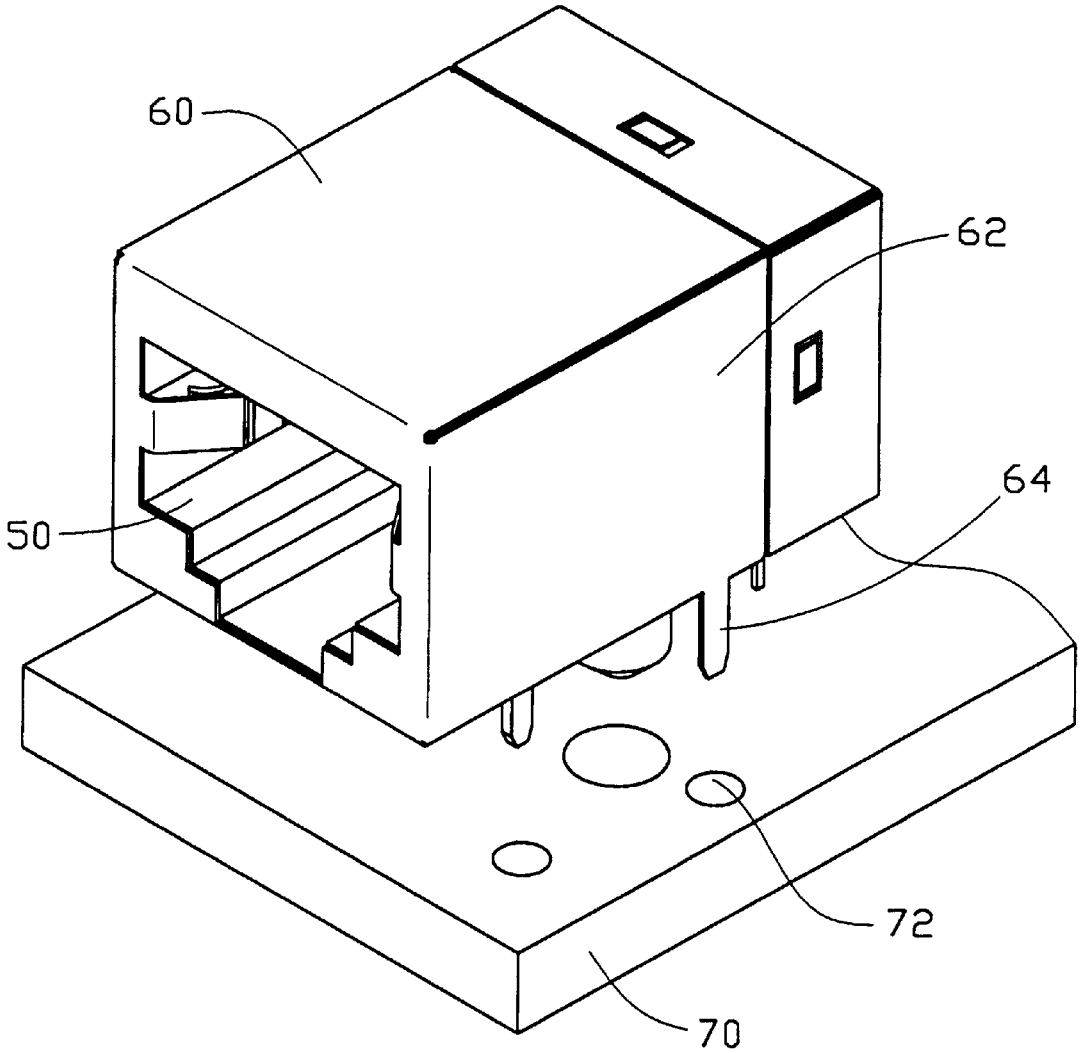
FIG. 4 (PRIOR ART)
FIG. 4 is an assembled view of a conventional connector.

Referring to FIG. 2 and FIG. 3, in assembly, the insert block 24 is first inserted into the housing 10 from the mounting opening 14, and engages with the housing 10 by the protrusions 242 being received in corresponding slots of the housing 10. Secondly, the main body 32 of the grounding member 30 is inserted into the recess 162 from the bottom side of the housing 10, the two lateral edges of each main body 32 being received in the corresponding grooves 164. Then the housing 10 is inserted into the front portion 42 of the shield 40, the lateral plates 422 covering the side walls 16 whereby the bevel arms 4224 of the resilient arms 4222 abut against the inclines 166 and the contact arms 4226 make electrical contact with the protruding ribs 322 of the main bodies 32 of the grounding members 30. The rear portion 44 of the shield 40 is then downwardly bent to cover the mounting opening 14 of the housing 10 and the clip portions 442 correspondingly engage with the indentations 4228 of the lateral plates 422 thereby positioning the front portion 42 and the rear portion 44. A grounding path is established from the shield 40 via the resilient arms 4222, the protruding ribs 322 and the solder pads 34 to the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a mating opening at a front face thereof;

a plurality of terminals each comprising a contact portion received in the mating opening of the housing and a solder portion extending out of the housing for soldering to a printed circuit board;

a pair of grounding members mounted in the housing, each grounding member comprising a main body for being retained in the housing, a protruding rib extending from the main body, and a solder pad extending from the main body for soldering to the printed circuit board; and a conductive shield covering the housing and comprising a pair of lateral plates, each lateral plate having a resilient arm for making electrical contact with the protruding rib of the grounding member.

2. The electrical connector as claimed in claim 1, wherein the housing comprises a pair of side walls, each side wall having a recess adjacent to a bottom of the housing and a pair of grooves defined in both lateral walls of each recess and in communication with the bottom of the housing, and wherein the main body of the grounding member has a pair of lateral edges inserted into the grooves and thereby retaining the main body in the recess.

3. The electrical connector as claimed in claim 2, wherein the resilient arm comprises a bevel arm extending from the lateral plate, and a contact arm at the end of the resilient arm for making electrical contact with the protruding rib of the grounding member; and an edge of each recess forms an incline from the side wall to the groove of the recess; and the bevel arm abuts against the incline when assembled.

4. An electrical connector comprising:

an insulative housing defining a front opening and two side walls;

a plurality of terminals received within the housing and accessible from said front opening;

a pair of recesses formed in the two side walls, respectively;

a pair of L-shaped grounding members positioned by the two side walls, respectively, each of said grounding members including a vertical main body retainably received within the corresponding recess, and a solder pad integrally horizontally extending outwardly from a bottom edge of the main body; and a conductive shield including at least two lateral plates covering said two side walls, each of said lateral plates defining a resilient arm extending into the corresponding recess and electrically and mechanically contacting the corresponding main body of the grounding member in said recess thereby establishing a grounding path from the shield, the resilient arm, the main body and the solder pad to a printed circuit board on which the connector is seated.

* * * * *